US011353024B2

(12) United States Patent
Xu et al.

(10) Patent No.: US 11,353,024 B2
(45) Date of Patent: Jun. 7, 2022

(54) SLIDE VANE, PUMP BODY ASSEMBLY, COMPRESSOR AND AIR CONDITIONER HAVING SAME

(71) Applicant: Gree Electric Appliances, Inc. Of Zhuhai, Guangdong (CN)

(72) Inventors: Jia Xu, Guangdong (CN); Liping Ren, Guangdong (CN); Qingfu Zhao, Guangdong (CN); Peng Liu, Guangdong (CN); Xiaotong Cheng, Guangdong (CN); Guanghui Wang, Guangdong (CN); Pengkai Wan, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 0 days.

(21) Appl. No.: 17/051,407

(22) PCT Filed: Dec. 12, 2018

(86) PCT No.: PCT/CN2018/120670
§ 371 (c)(1),
(2) Date: Oct. 28, 2020

(87) PCT Pub. No.: WO2020/042435
PCT Pub. Date: Mar. 5, 2020

(65) Prior Publication Data

US 2021/0239117 A1 Aug. 5, 2021

(30) Foreign Application Priority Data

Aug. 31, 2018 (CN) ..... 201811015500.7

(51) Int. Cl.
*F01C 1/00* (2006.01)
*F03C 2/00* (2006.01)
(Continued)

(52) U.S. Cl.
CPC ..... *F04C 18/3441* (2013.01); *F01C 21/0809* (2013.01); *F01C 21/0845* (2013.01); *F04C 29/00* (2013.01)

(58) Field of Classification Search
CPC ..... F04C 18/344; F04C 18/3441; F04C 18/3442; F04C 29/00; F04C 29/12;
(Continued)

(56) References Cited

U.S. PATENT DOCUMENTS 2,447,961 A * 8/1948 Rodway ..... F04C 18/352 418/133
4,402,653 A * 9/1983 Maruyama ..... F04C 27/005 418/76
(Continued)

FOREIGN PATENT DOCUMENTS

CN 103620223 A 3/2014
CN 206655817 U 11/2017
(Continued)

OTHER PUBLICATIONS

JP60132089A—Onoda et al.—Rotary Compressor—Jul. 13, 1985—copy of the English Translation (Year: 1985).*
(Continued)

*Primary Examiner* — Theresa Trieu
(74) *Attorney, Agent, or Firm* — Victoria Friedman; Dennemeyer & Associates, LLC

(57) ABSTRACT

The disclosure discloses a slide vane, a pump body assembly, a compressor and an air conditioner having the same. The pump body assembly includes a cylinder assembly, a flange portion, a rotating shaft and the slide vane. The flange portion is connected to the cylinder assembly, a working cavity is formed between the flange portion and the cylinder assembly, and an avoidance portion is provided on a surface, located in the working cavity, of the flange portion. A
(Continued)

limiting structure is provided in an accommodation portion. The limiting structure is provided with an avoidance position in the accommodation portion, and at least part of the limiting structure is provided with a limiting position protruded out of a surface of the accommodation portion. Such a configuration avoids friction occurring between the head of the slide vane and the cavity wall of the working cavity.

17 Claims, 7 Drawing Sheets

(51) Int. Cl.

| | |
|---|---|
| ***F03C 4/00*** | (2006.01) |
| ***F04C 18/00*** | (2006.01) |
| ***F04C 18/344*** | (2006.01) |
| ***F04C 29/00*** | (2006.01) |
| ***F01C 21/08*** | (2006.01) |

(58) Field of Classification Search
CPC ..... F04C 2210/1005; F01C 1/344; F01C 21/0809; F01C 21/0818; F01C 21/0836; F01C 21/0845; F01C 21/089
See application file for complete search history.

(56) References Cited

U.S. PATENT DOCUMENTS

| | | | | | |
|---|---|---|---|---|---|
| 5,074,769 | A * | 12/1991 | Kazaoka | ..... | F01C 21/0845 418/266 |
| 5,470,215 | A * | 11/1995 | Stone | ..... | F01C 21/0845 418/266 |
| 2017/0342982 | A1 * | 11/2017 | Wan | ..... | F04C 18/344 |

FOREIGN PATENT DOCUMENTS

| | | | | | |
|---|---|---|---|---|---|
| CN | 10884357 | A | | 11/2018 | |
| JP | 60132089 | A | * | 7/1985 | ..... F01C 21/0836 |
| JP | 2006329053 | A | | 12/2006 | |
| JP | 2010077891 | A | | 4/2010 | |

OTHER PUBLICATIONS

International Search Report issued in connection with PCT Application No. PCT/CN2018/120670 dated May 29, 2019.
Supplemental European Search Report received for EP Patent Application No. 18931693, dated May 31, 2021, 8 pages.

* cited by examiner

SLIDE VANE, PUMP BODY ASSEMBLY, COMPRESSOR AND AIR CONDITIONER HAVING SAME

CROSS-REFERENCE TO RELATED APPLICATIONS

This is a 35 U.S.C. 371 National Stage Patent Application of International Application No. PCT/CN2018/120670, filed Dec. 12, 2018, which claims priority to Chinese application 201811015500.7, filed Aug. 31, 2018, each of which is hereby incorporated by reference in its entirety.

TECHNICAL FIELD

The disclosure relates to the technical field of air conditioning devices, and in particular to a slide vane, a pump body assembly, a compressor and an air conditioner having the same.

BACKGROUND

An application range of a rotary slide-vane-type compressor is limited due to high mechanical power consumption, and frictional power consumption caused by a head of a slide vane and an inner wall of a cylinder working cavity is a main source of the mechanical power consumption of the compressor, as shown in FIG. 1, a traditional rotation slide vane structure needs to ensure followability of the slide vane in a rotation working process, a back pressure must be provided between a slide vane tail and a slide vane groove thereof, and the back pressure is applied to an inner wall of a cylinder through a head of a slide vane and turned into a frictional resistance, thereby the frictional power consumption is generated. In an existing technology, there is a problem of the large frictional power consumption between the head of the slide vane and the inner wall of the working cavity.

SUMMARY

Some embodiments of the disclosure is to provide a slide vane, a pump body assembly, a compressor and an air conditioner having the same, as to solve a problem of large frictional power consumption between a head of a slide vane and an inner wall of a working cavity in an existing technology.

In some embodiments of the disclosure, a pump body assembly is provided, including: a cylinder assembly; a flange portion, herein the flange portion is connected to the cylinder assembly, a working cavity is formed between the flange portion and the cylinder assembly, and an avoidance portion is provided on a surface, located in the working cavity, of the flange portion; a rotating shaft, herein the rotating shaft passes through the flange portion and the cylinder assembly, and the rotating shaft is provided with a slide vane groove; a slide vane, herein the slide vane is slidably provided in the slide vane groove, an end face, towards the flange portion, of the slide vane is provided with an accommodation portion, a limiting structure is provided in the accommodation portion, the limiting structure is provided with an avoidance position in the accommodation portion, and at least part of the limiting structure is provided with a limiting position protruded out of a surface of the accommodation portion; and herein, the rotating shaft may drive the slide vane to be rotated, such that the working cavity corresponding to the slide vane performs an air suction operation and an air exhaust operation, when the working cavity performs the air suction operation, the limiting structure cooperates with the avoidance portion, such that the limiting structure is located at the limiting position, and a head of the slide vane is arranged at a distance from a cavity wall of the working cavity.

In some embodiments, when the working cavity performs the air exhaust operation, the limiting structure is gradually far away from the avoidance portion, such that the limiting structure is gradually moved to the avoidance position.

In some embodiments, the accommodation portion is a limiting groove, the limiting groove is installed on an end face at one side, towards the flange portion, of a slide vane body; or the accommodation portion is a limiting hole, the limiting hole is installed on the end face at the one side, towards the flange portion, of the slide vane body; or the accommodation portion is a limiting groove, the limiting groove is installed on an end face at one side, towards the flange portion, of a slide vane body, the accommodation portion is a limiting hole, the limiting hole is installed on the end face at the one side, towards the flange portion, of the slide vane body.

In some embodiments, the limiting structure includes: a ball, the ball is moveably provided in the accommodation portion; and a spring, the spring is provided in the accommodation portion, a first end of the spring is pressed against a side wall of the accommodation portion, and a second end of the spring is pressed against the ball, when the working cavity performs the air suction operation, a pre-tightening force is applied to the ball by the spring, such that a part of the ball is positioned outside the accommodation portion.

In some embodiments, the flange portion includes an upper flange and a lower flange, the avoidance portion is installed on the upper flange; or the avoidance portion is installed on the lower flange; or one avoidance portion is installed on the upper flange, another avoidance portion is installed on the lower flange.

In some embodiments, the upper flange or the lower flange includes a flange body, the flange body is provided with a shaft hole through which the rotating shaft passes, the avoidance portion includes an avoidance concave portion, the avoidance concave portion is installed at a hole wall of the shaft hole, when the working cavity performs the air suction operation, the pre-tightening force is applied to the ball by the spring, such that a part of the ball is positioned in the avoidance concave portion, and a surface of the part of the ball is pressed against a side wall of the avoidance concave portion, so the head of the slide vane is arranged at a distance away from a cavity wall of the working cavity.

In some embodiments, the avoidance concave portion includes: a limiting section, the limiting section is installed at an edge of the shaft hole, a depth direction of the limiting section is extended to be configured along an axis direction of the shaft hole, a bottom surface at one side, close to the shaft hole, of the limiting section is aligned to a hole edge of the shaft hole, the limiting section is provided with a limiting surface, the limiting surface is configured away from the hole edge of the shaft hole and configured to form an included angle with the bottom surface, when the ball is positioned in the limiting position, a part of the ball is pressed against the limiting surface.

In some embodiments, the avoidance portion further includes: a first transition section, a first end of the first transition section is connected with a first end of the limiting section, a second end of the first transition section is connected with a surface at one side, towards the working cavity, of the flange body, a height from the first end of the first transition section to the second end of the first transition section is gradually increased, such that the ball is gradually moved into the accommodation portion, until the ball is positioned in the avoidance position.

In some embodiments, the avoidance portion further includes: a second transition section, a first end of the second transition section is connected with a second end of the limiting section, a second end of the second transition section is connected with the surface at the one side, towards the working cavity, of the flange body, a height from the first end of the second transition section to the second end of the second transition section is gradually increased and gently extended to be configured, such that the ball is gradually slid out from the accommodation portion, until the ball is positioned in the limiting position.

In some embodiments, there are multiple slide vane grooves, and there are multiple slide vanes, the multiple slide vane grooves and the multiple slide vanes are configured correspondingly one by one, and the working cavity is formed between the two neighboring slide vanes.

According to another aspect of the disclosure, a slide vane structure is provided, including: a slide vane body, at least one end surface of the slide vane body is provided with an accommodation portion; a limiting structure, the limiting structure is moveably provided in the accommodation portion, the limiting structure has an avoidance position positioned in the slide vane body, and the limiting structure has a limiting position protruded out of a surface of the slide vane body.

In some embodiments, the accommodation portion is a limiting groove, the limiting groove is installed on an end face at one side, towards the flange portion, of the slide vane body; or the accommodation portion is a limiting hole, the limiting hole is installed on the end face at the one side, towards the flange portion, of the slide vane body; or the accommodation portion is a limiting groove, the limiting groove is installed on an end face at one side, towards the flange portion, of the slide vane body, the accommodation portion is a limiting hole, the limiting hole is installed on the end face at the one side, towards the flange portion, of the slide vane body.

In some embodiments, the limiting structure includes: a ball, the ball is moveably provided in the accommodation portion; and a spring, the spring is provided in the accommodation portion, a first end of the spring is pressed against a side wall of the accommodation portion, and a second end of the spring is pressed against the ball, a pre-tightening force is applied to the ball by the spring, such that a part of the ball is positioned outside the accommodation portion.

In some embodiments, the slide vane body is provided with an air exhaust hole communicated with the accommodation portion.

In some embodiments, there are two accommodation portions, the two accommodation portions are respectively provided on two opposite end faces of the slide vane body, the two accommodation portions are configured to be communicated, the air exhaust hole is provided in a middle of a tail of the slide vane body, and the air exhaust hole is communicated with the two accommodation portions.

In some embodiments of the disclosure, a compressor is provided, including a pump body assembly, the pump body assembly is the above pump body assembly.

In some embodiments of the disclosure, an air conditioner is provided, including a pump body assembly, herein the pump body assembly is the above pump body assembly.

A technical scheme of the disclosure is applied, through configuring the limiting structure on the slide vane, and configuring the avoidance portion on the surface of the flange portion, when the working cavity performs the air suction operation, the limiting structure cooperates with the avoidance portion, such that the limiting structure is positioned in the limiting position, the head of the slide vane is arranged at the distance from the cavity wall of the working cavity, such a configuration is capable of avoiding the friction between the head of the slide vane and the cavity wall of the working cavity, thereby reducing the power consumption of the pump body assembly.

BRIEF DESCRIPTION OF THE DRAWINGS

The accompanying drawings, which constitute a part of the present application, are used to provide a further understanding of the disclosure, and the exemplary embodiments of the disclosure and the description thereof are used to explain the disclosure, but do not constitute improper limitations to the disclosure. In the drawings.

Figure 1:
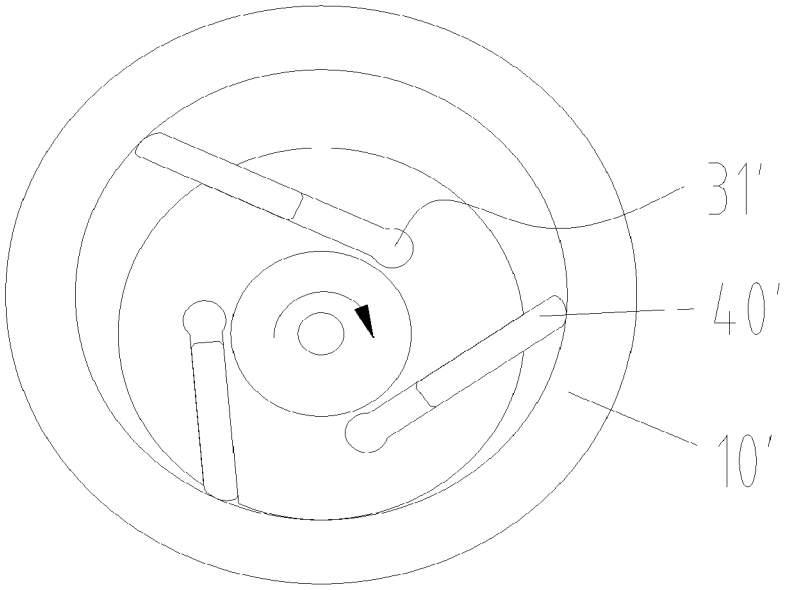
Fig. 1 PRIOR ART
FIG. 1 shows a structure schematic diagram of a pump body assembly in an existing technology.

Herein, the above drawings include the following drawing reference signs:

10. Cylinder assembly;

20. Flange portion; 21. Avoidance concave portion; 211. Limiting section; 212. First transition section; 213. Second transition section; 22. Shaft hole;

30. Rotating shaft; 31. Slide vane groove;

40. Slide vane; 41. Slide vane body; 42. Accommodation portion; 43. Air exhaust hole;

50. Limiting structure; 51. Ball; and 52. Spring.

DETAILED DESCRIPTION OF THE EMBODIMENTS

It should be noted that the embodiments in the present application and the features in the embodiments may be combined with each other without conflict. The disclosure will be described in detail below with reference to the accompanying drawings and in conjunction with the embodiments.

It should be noted that terms used here are only used for describing specific implementation modes, and are not intended to limit the exemplary implementation modes according to the present application. As used herein, unless clearly specified otherwise in the context, a singular form is also intended to include a plural form. In addition, it should also be understood that when the terms "comprising" and/or "including" are used in the description, it is indicated that there are features, steps, operations, devices, components and/or combinations thereof.

It should be noted that the terms "first", "second", and the like in the specification and claims of the present application and in the above drawings are used to distinguish similar objects and are not necessarily used to describe a specific sequence or order. It will be appreciated that the data used in this way is interchanged where appropriate, so that the implementation manners of the present application described herein can be implemented, for example, in an order other than those illustrated or described herein. In addition, the terms "include" and "have" and any variations thereof are intended to cover non-exclusive inclusions. For example, a process, method, system, product, or equipment that comprises a series of steps or units need not be limited to those steps or units that are explicitly listed, and may instead include other steps or units that are not explicitly listed or inherent to these processes, methods, products or equipment.

For ease of description, spatially relative terms such as "on", "over", "on an upper surface", "above", etc. may be used herein to describe a spatial position relationship between one device or feature as shown in the figures and other devices or features. It will be appreciated that the spatially relative terms are intended to comprise different orientations of the device in use or operation in addition to the orientation of the device described in the figures. For example, if the device in the figures is turned upside down, the device described as "over other devices or configurations" or "on other devices or configurations" will be positioned "below other devices or configurations" or "under other devices or configurations". Thus, the exemplary term "over" may include both "above" and "below". The device may also be positioned in other different manners (rotated for 90 degrees or at other orientations), and the spatially relative descriptors used herein are interpreted accordingly.

Now, the exemplary implementation modes according to the present application are described in more detail with reference to the drawings. However, these exemplary implementation modes are implemented in multiple different forms, and should not be interpreted to be limited to the implementation modes described here. It should be understood that these implementation modes are provided to make the disclosure of the present application thorough and complete, and adequately convey concepts of these exemplary implementation modes to those of ordinary skill in the art, in the drawings, for clarity, thicknesses of layers and regions are enlarged, and the same reference sign is used to show the same device, therefore the description of them is omitted.

As shown in FIG. 2 to FIG. 11, according to some embodiments of the disclosure, a pump body assembly is provided.

Figure 2:
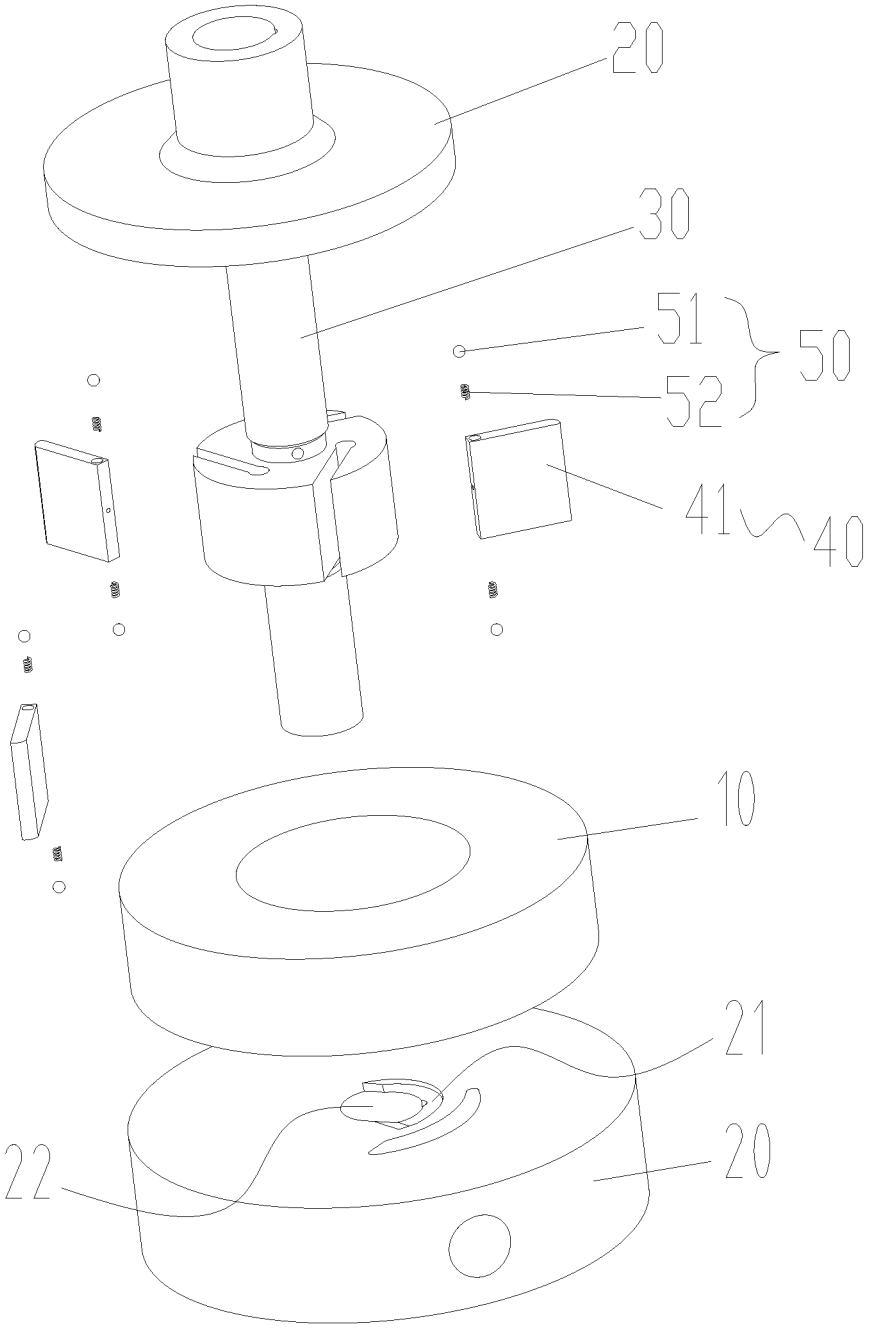
FIG. 2 shows an exploded structure schematic diagram of an embodiment of the pump body assembly according to the disclosure.
Figure 3:
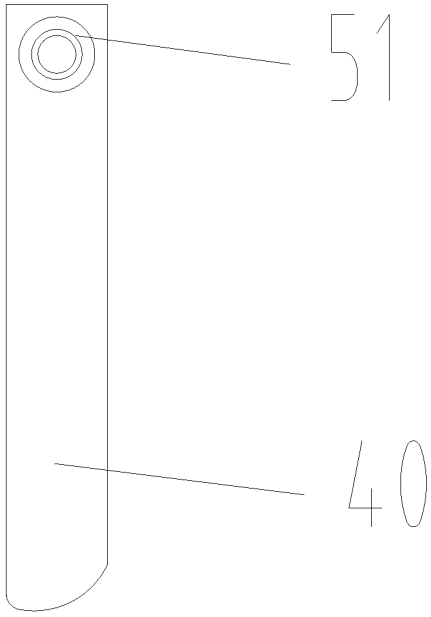
FIG. 3 shows a structure schematic diagram of one direction of a slide vane of the pump body assembly according to the disclosure.

As shown in FIG. 2 specifically, the pump body assembly includes a cylinder assembly 10, a flange portion 20, a rotating shaft 30 and a slide vane 40, the flange portion 20 is connected to the cylinder assembly 10, a working cavity is formed between the flange portion 20 and the cylinder assembly 10, and an avoidance portion is provided on a surface, located in the working cavity, of the flange portion 20, the rotating shaft 30 passes through the flange portion 20 and the cylinder assembly 10, and the rotating shaft 30 is provided with a slide vane groove 31, the slide vane 40 is slidably provided in the slide vane groove 31, an end face, towards the flange portion 20, of the slide vane 40 is provided with an accommodation portion 42, a limiting structure 50 is provided in the accommodation portion 42, the limiting structure 50 is provided with an avoidance position in the accommodation portion 42, and at least part of the limiting structure 50 is provided with a limiting position protruded out of a surface of the accommodation portion 42, and herein, the rotating shaft 30 may drive the slide vane 40 to be rotated, such that the working cavity corresponding to the slide vane 40 performs an air suction operation and an air exhaust operation, when the working cavity performs the air suction operation, the limiting structure 50 cooperates with the avoidance portion, such that the limiting structure 50 is located at the limiting position, and a head of the slide vane 40 is arranged at a distance from a cavity wall of the working cavity.

In the present embodiment, through configuring the limiting structure on the slide vane, and configuring the avoidance portion on the surface of the flange portion, when the working cavity performs the air suction operation, the limiting structure cooperates with the avoidance portion, such that the limiting structure is positioned in the limiting position, the head of the slide vane is arranged at the distance from the cavity wall of the working cavity, such a configuration is capable of avoiding the friction between the head of the slide vane and the cavity wall of the working cavity, thereby reducing the power consumption of the pump body assembly.

Figure 9:
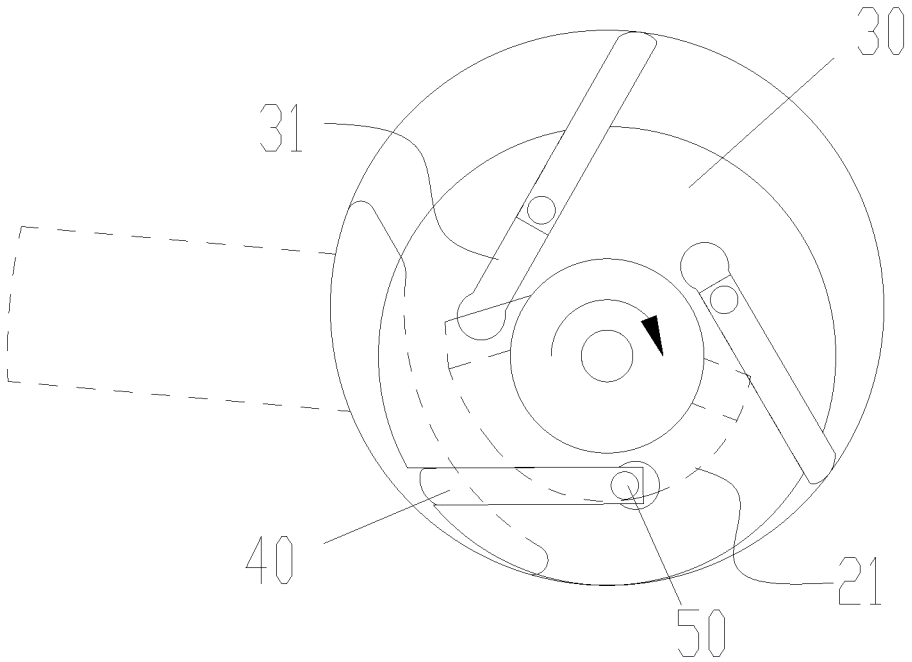
FIG. 9 shows a structure schematic diagram of another state of the pump body assembly according to the disclosure.
Figure 10:
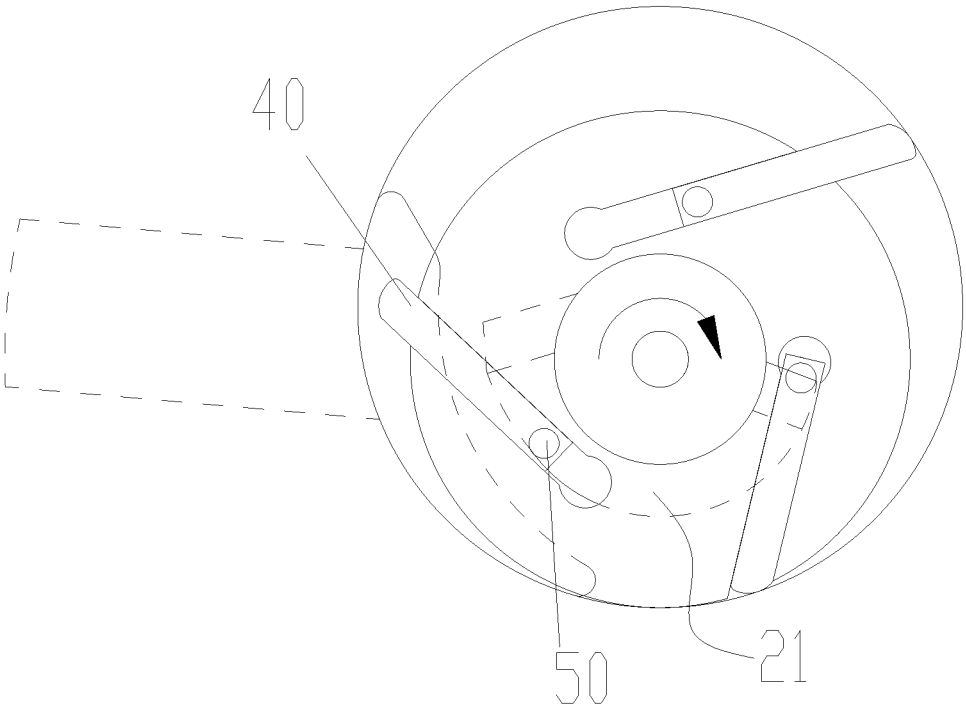
FIG. 10 shows a structure schematic diagram of another state of the pump body assembly according to the disclosure.
Figure 11:
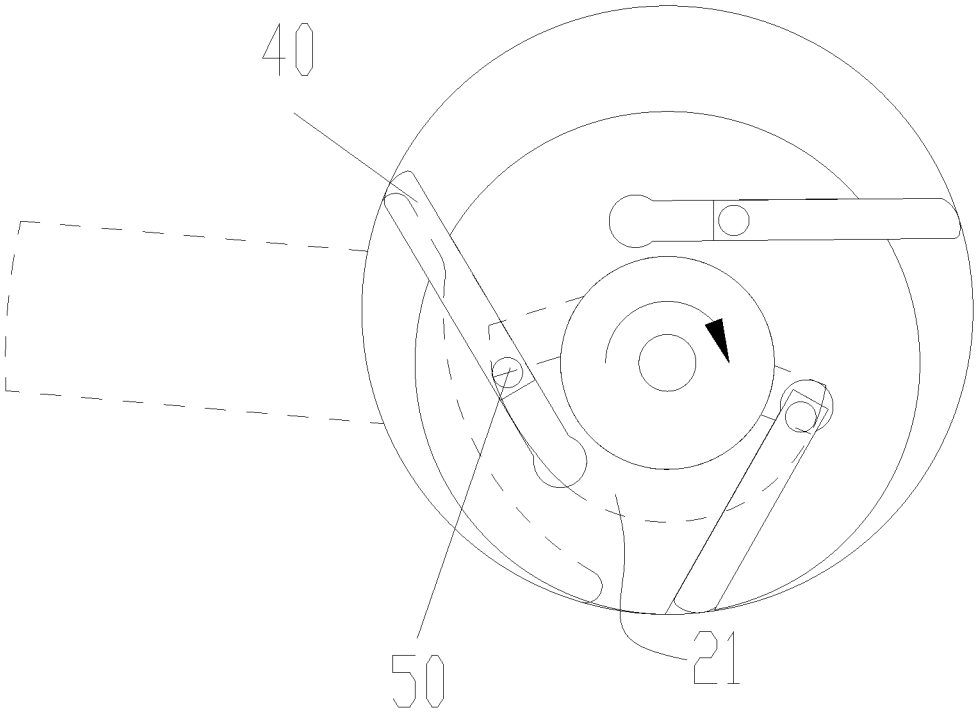
FIG. 11 shows a structure schematic diagram of another state of the pump body assembly according to the disclosure.

As shown in FIG. 9 to FIG. 11, when the working cavity performs the air exhaust operation, the limiting structure 50 is gradually far away from the avoidance portion, such that the limiting structure 50 is gradually moved to the avoidance position. Through cooperation of the limiting structure and the avoidance portion, when the limiting structure is positioned in the avoidance portion, at this moment the working cavity is located in an air suction state, a circumferential displacement of the slide vane is limited by the limiting structure, and the friction between the head of the slide vane and the cavity wall of the working cavity is avoided, when the limiting structure is moved to the avoidance position, at this moment the working cavity is located in an air exhaust state, the circumferential displacement of the slide vane is not limited by the limiting structure.

In the present embodiment, the accommodation portion 42 is a limiting groove, the limiting groove is installed on an end face at one side, towards the flange portion 20, of a slide vane body 41, and/or the accommodation portion 42 is a limiting hole, the limiting hole is installed on the end face at the one side, towards the flange portion 20, of the slide vane body 41, certainly the accommodation portion is arranged at two ends of the slide vane body, or one end is the limiting groove, and the other end is the limiting hole, the limiting structure is moveably configured through the limiting groove or the limiting hole.

Figure 4:
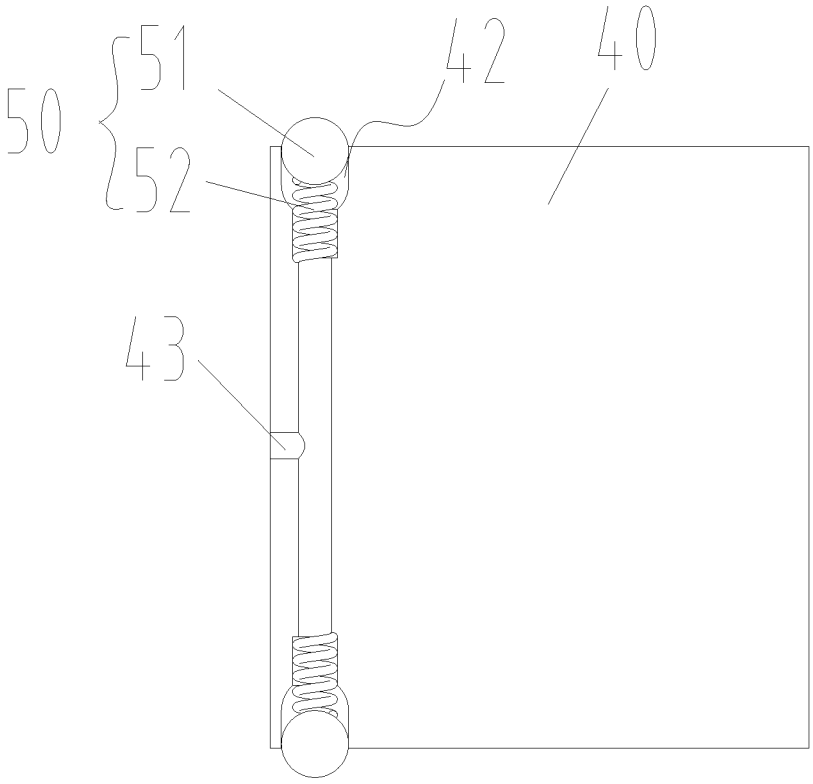
FIG. 4 shows a structure schematic diagram of another direction of the slide vane of the pump body assembly according to the disclosure.

As shown in FIG. 4, the limiting structure 50 includes a ball 51 and a spring 52, the ball 51 is moveably provided in the accommodation portion 42, the spring 52 is provided in the accommodation portion 42, a first end of the spring 52 is pressed against a side wall of the accommodation portion 42, and a second end of the spring 52 is pressed against the ball 51, when the working cavity performs the air suction operation, a pre-tightening force is applied to the ball 51 by the spring 52, such that a part of the ball 51 is positioned outside the accommodation portion 42. Elastic force and compressing capacity of the spring are used, and the ball is ejected out of the accommodation portion or pressed into the accommodation portion, such a configuration is capable of enabling the slide vane body to contact and cooperate with the avoidance portion through the ball, the head of the slide vane is arranged at the distance from the cavity wall of the working cavity, and such a configuration is capable of avoiding the friction between the head of the slide vane and the cavity wall of the working cavity.

As shown in FIG. 2 and FIG. 4, the flange portion 20 includes an upper flange and/or a lower flange, the avoidance portion is installed on at least one of the upper flange and the lower flange. Such a configuration is capable of enabling the slide vane to be subjected to a uniform constraining force when the circumferential displacement of the slide vane is limited.

Figure 6:
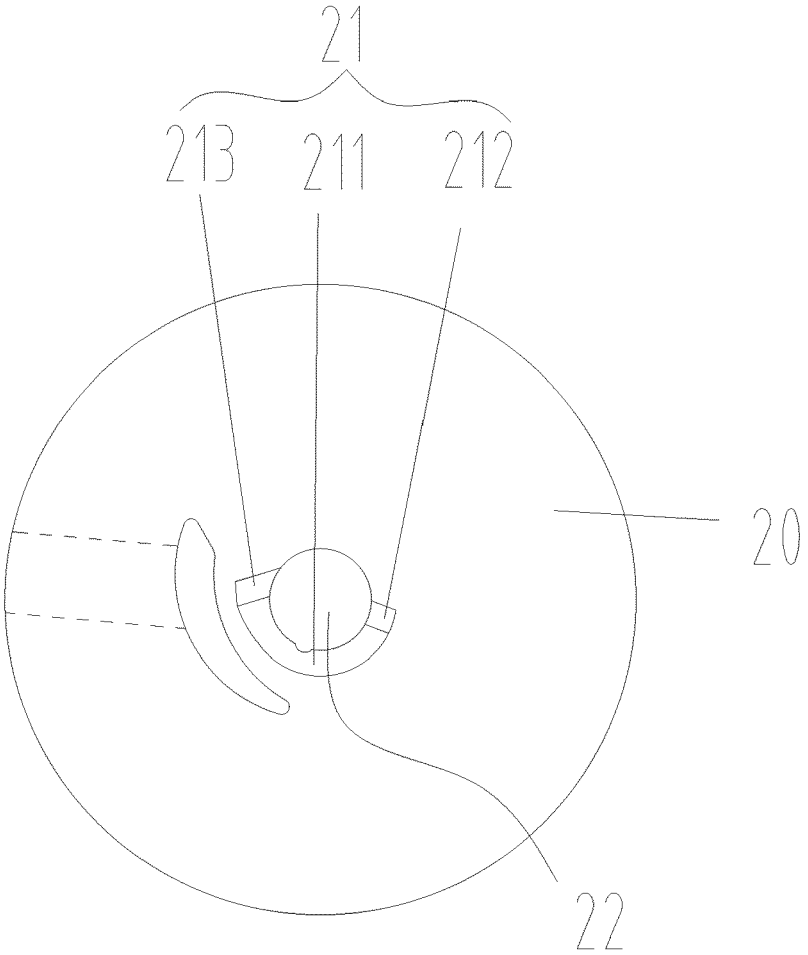
FIG. 6 shows a structure schematic diagram of another direction of the flange portion of the pump body assembly according to the disclosure.
Figure 7:
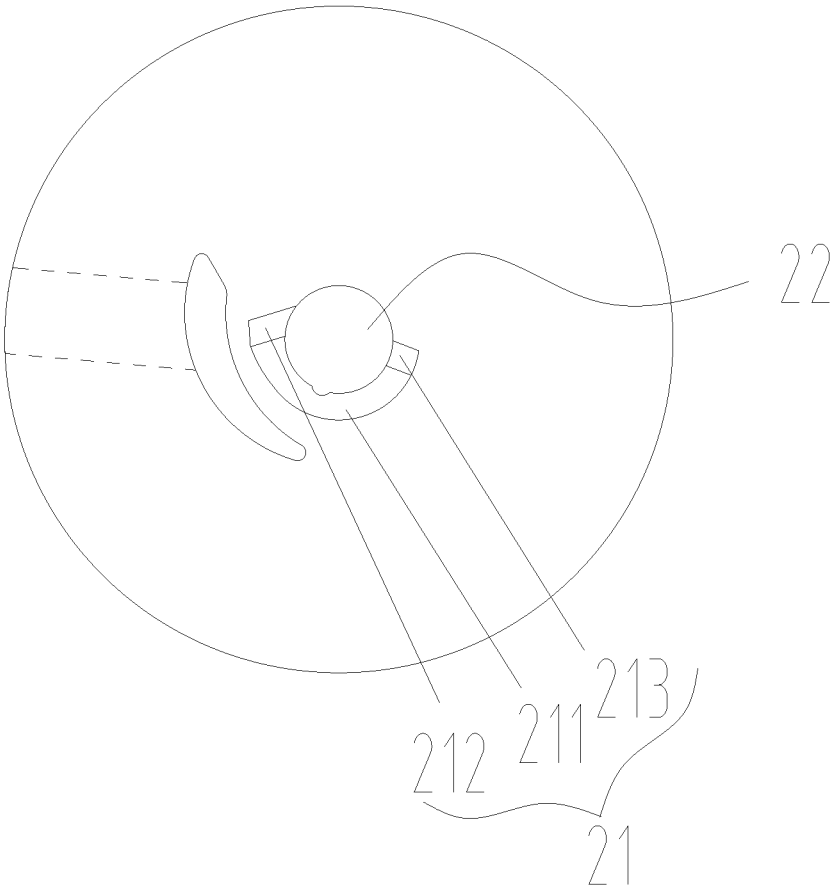
FIG. 7 shows a structure schematic diagram of another direction of the flange portion of the pump body assembly according to the disclosure.
Figure 8:
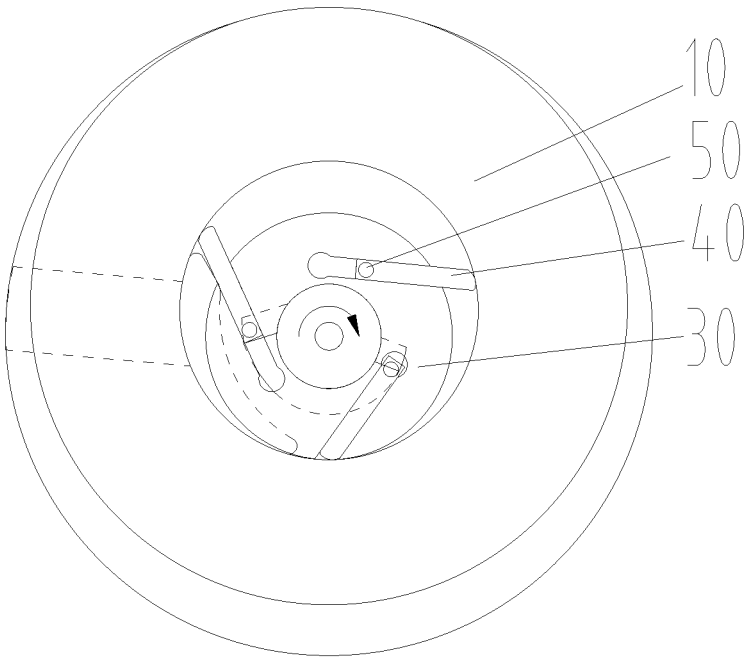
FIG. 8 shows a structure schematic diagram of one state the pump body assembly according to the disclosure.

As shown in FIG. 6 to FIG. 7, the upper flange or the lower flange includes a flange body, the flange body is provided with a shaft hole 22 through which the rotating shaft 30 passes, the avoidance portion includes an avoidance concave portion 21, the avoidance concave portion 21 is installed at a hole wall of the shaft hole 22, when the working cavity performs the air suction operation, the pre-tightening force is applied to the ball 51 by the spring 52, such that a part of the ball 51 is positioned in the avoidance concave portion 21, and a surface of the part of the ball 51 is pressed against a side wall of the avoidance concave portion 21, so the head of the slide vane 40 is arranged at a distance away from a cavity wall of the working cavity. Through a side wall of the avoidance concave portion, circumferential constraint of the rotating shaft is performed on the surface of the ball, therefore the head of the slide vane 40 is arranged at the distance away from the cavity wall of the working cavity.

Figure 5:
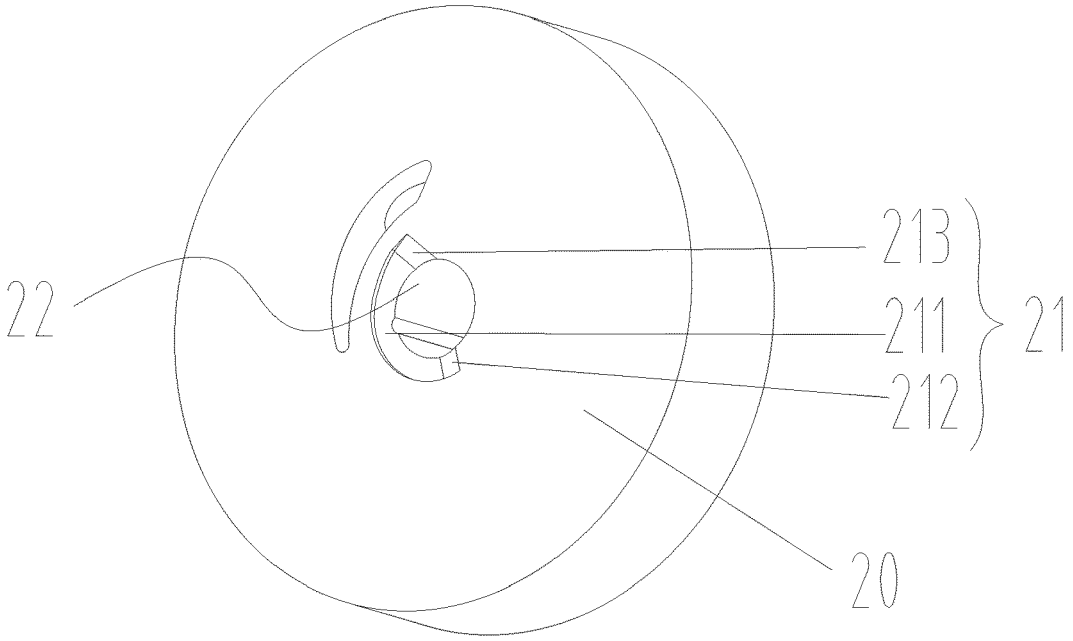
FIG. 5 shows a structure schematic diagram of one direction of a flange portion of the pump body assembly according to the disclosure.

As shown in FIG. 5 to FIG. 7, the avoidance concave portion 21 includes a limiting section 211, the limiting section 211 is installed at an edge of the shaft hole 22, a depth direction of the limiting section 211 is extended to be configured along an axis direction of the shaft hole 22, a bottom surface at one side, close to the shaft hole 22, of the limiting section 211 is aligned to a hole edge of the shaft hole 22, the limiting section 211 is provided with a limiting surface, the limiting surface is configured away from the hole edge of the shaft hole 22 and configured to form an included angle with the bottom surface, when the ball 51 is positioned in the limiting position, a part of the ball is pressed against the limiting surface. The avoidance portion further includes a first transition section 212, a first end of the first transition section 212 is connected with a first end of the limiting section 211, a second end of the first transition section 212 is connected with a surface at one side, towards the working cavity, of the flange body, a height from the first end of the first transition section 212 to the second end of the first transition section 212 is gradually increased, such that the ball 51 is gradually moved into the accommodation portion 42, until the ball 51 is positioned in the avoidance position. The avoidance portion further includes a second transition section 213, a first end of the second transition section 213 is connected with a second end of the limiting section 211, a second end of the second transition section 213 is connected with the surface at the one side, towards the working cavity, of the flange body, a height from the first end of the second transition section 213 to the second end of the second transition section 213 is gradually increased and gently extended to be configured, such that the ball 51 is gradually slid out from the accommodation portion 42, until the ball 51 is positioned in the limiting position. A starting section, namely the first transition section 212, and an end section, namely the second transition section 213, of the avoidance concave portion 21 are a slope form, the ball conveniently enters and leaves the avoidance concave portion 21. When the slide vane assembly is located in an air suction section, the ball is ejected out by the elastic force of the spring and enters the avoidance concave portion 21, and a limiting effect is achieved, after the air suction is completed, the slide vane body leaves a limiting area, the ball extrudes the spring under a pressure of the end face of the flange, the ball is pressed back to a ball hole, limiting is not produced to the slide vane.

In the present embodiment, there are multiple slide vane grooves 31, and there are multiple slide vanes 40, the multiple slide vane grooves 31 and the multiple slide vanes 40 are configured correspondingly one by one, and the working cavity is formed between the two neighboring slide vanes. In the present embodiment, the working cavity is divided to 4 portions through three slide vanes, a main shaft is driven to be rotated by a motor, and the slide vanes are driven to be moved, thereby air suction, compressing and air exhaust processes of the working cavity are achieved.

According to another aspect of the disclosure, a slide vane structure is provided, the slide vane structure includes a slide vane body 41 and a limiting structure 50, at least one end surface of the slide vane body 41 is provided with an accommodation portion 42, the limiting structure 50 is moveably provided in the accommodation portion 42, the limiting structure 50 has an avoidance position positioned in the slide vane body 41, and the limiting structure 50 has a limiting position protruded out of a surface of the slide vane body 41. Through configuring the limiting structure on the slide vane, and configuring the avoidance portion on the surface of the flange portion, when the working cavity of the pump body assembly performs the air suction operation, the limiting structure cooperates with the avoidance portion, such that the limiting structure is positioned in the limiting position, the head of the slide vane is arranged at the distance from the cavity wall of the working cavity, such a configuration is capable of avoiding the friction between the head of the slide vane and the cavity wall of the working cavity, thereby reducing the power consumption of the pump body assembly.

In the present embodiment, the accommodation portion 42 is a limiting groove, the limiting groove is installed on an end face at one side, towards the flange portion 20, of the slide vane body 41, and/or the accommodation portion 42 is a limiting hole, the limiting hole is installed on the end face at the one side, towards the flange portion 20, of the slide vane body 41. Certainly the accommodation portion is arranged at two ends of the slide vane body, or one end is the limiting groove, and the other end is the limiting hole, the limiting structure is moveably configured through the limiting groove or the limiting hole.

Further, the limiting structure 50 includes a ball 51 and a spring 52, the ball 51 is moveably provided in the accommodation portion 42, the spring 52 is provided in the accommodation portion 42, a first end of the spring 52 is pressed against a side wall of the accommodation portion 42, and a second end of the spring 52 is pressed against the ball 51, a pre-tightening force is applied to the ball 51 by the spring 52, such that a part of the ball 51 is positioned outside the accommodation portion 42. The pre-tightening force is applied to the ball through the spring, the ball may be conveniently hidden in the accommodation portion or the ball is ejected from the interior of the accommodation portion to the exterior of the accommodation portion.

In the present embodiment, the slide vane body 41 is provided with an air exhaust hole 43 communicated with the accommodation portion 42. Because a volume is changed during a working process of the ball, the slide vane is provided with the air exhaust hole, as to prevent the ball from extruding air or oil so that it is difficult to enter and exit from the accommodation portion.

Herein, there are two accommodation portions 42, the two accommodation portions 42 are respectively provided on two opposite end faces of the slide vane body 41, the two accommodation portions 42 are configured to be communicated, the air exhaust hole 43 is provided in a middle of a tail of the slide vane body 41, and the air exhaust hole 43 is communicated with the two accommodation portions 42. Through enabling the air exhaust hole to be communicated with the accommodation portions, the ball may conveniently enter and leave the accommodation portion. A design of a non air suction section back pressure groove is not affected by the spring-ball structure, and the design is more flexible and convenient.

According to another aspect of the disclosure, a compressor is provided, including a pump body assembly, the pump body assembly is the pump body assembly of the above embodiment.

According to another aspect of the disclosure, an air conditioner is provided, including a pump body assembly, the pump body assembly is the pump body assembly of the above embodiment.

As shown in FIG. 1, in an existing technology, because a rotation slide vane 40' in a cylinder assembly 10' must ensure the followability of the slide vane during the rotation working process, a slide vane groove 31' at the tail thereof must provide a certain back pressure, the back pressure is applied to an inner wall of a cylinder under the effect of the head of the slide vane and turned into a frictional resistance, thereby the frictional power consumption is generated.

According to structure features of a rotary slide-vane-type compressor, the working process is divided into three phases of an air suction section, a compressing section and an air exhaust section. In the air suction section, the head of the slide vane is an air suction pressure, and the tail is a back pressure, at this moment, the head of the slide vane has the maximum acting force on the inner wall of the cylinder, and the air suction section slide vane is stretched to be moved along with the slide vane groove, a rotation radius of the head of the slide vane is an increased process, namely a linear velocity of the head of the slide vane is greater and greater, according to W=FV, the power consumption of the head of the slide vane is not only large in the air suction section, but also an increased process, therefore the power consumption of the head of the slide vane occupies a larger proportion in a whole operation period. A spring-ball limiting structure is configured through the end face at the tail of the slide vane, the spring-ball limiting structure cooperates with the avoidance concave portion 21 of the upper and lower flanges, it is guaranteed that the head of the air suction section slide vane does not contact with the inner wall of the cylinder in a large gap mode, and it has a significant effect of reducing the power consumption there.

In addition, two sides of the air suction section slide vane are the air suction pressures, the limiting structure ensures that the slide vane is communicated with the inner wall of the cylinder in the large gap mode, namely the gap between the head of the head of the air suction section slide vane and the inner wall of the cylinder does not need to be strictly controlled, the frictional power consumption is reduced, at the same time a problem of an insufficient air suction amount in an air suction cavity is solved, and it is beneficial to improve a cooling capacity of the compressor.

As shown in FIG. 8 to FIG. 11, a working process of the compressor is divided into three phases of air suction, compression and air exhaust, in a rotating shaft rotation process, the slide vane is driven to be moved in order to reduce the frictional power consumption between the head of the slide vane and the inner wall of the cylinder. The slide vane 40 is taken as an example, when the slide vane 40 is positioned in a position of FIG. 8, at this moment the spring-ball limiting structure just acts on the avoidance concave portion 21, and the slide vane 40 is located in the limiting state; when the slide vane 40 is positioned in a position of FIG. 9, at this moment the slide vane 40 is located in the limiting state, the slide vane 40 is not stretched out, left and right cavities of the slide vane 40 are in communication state, an air suction channel is shared, and it is beneficial to the air suction; when the slide vane 40 is positioned in a position of FIG. 10, at this moment the slide vane 40 is located in the limiting state, the slide vane 40 is gradually stretched out, the left and right cavities of the slide vane 40 are still in communication state, the air suction channel is shared, and it is beneficial to the air suction; when the slide vane 40 is positioned in a position of FIG. 11, at this moment the slide vane 40 is just located in a non-limiting state, the slide vane 40 is completely stretched out, and the air suction is completed. In the whole air suction process, the slide vane 40 does not contact with the inner wall of the cylinder, and a large gap is kept, in this way, not only the frictional power consumption in the air suction section is eliminated, but also the problem of the insufficient air suction is solved, and the performance of the compressor is apparently improved.

In addition to the above, it should be noted that "one embodiment", "another embodiment", "embodiment" and the like mentioned in the description refer that specific features, structures or characteristics described in combination with the embodiment are included in at least one embodiment generally described in the present application. The same expression occurring in multiple places in the description does not necessarily refer to the same embodiment. Furthermore, when one specific feature, structure or characteristic is described in combination with any one embodiment, it is claimed that such feature, structure or characteristic achieved in combination with other embodiments also falls within a scope of the disclosure.

In the above embodiments, the description of each embodiment has own emphasis, and a part that is not described in detail in a certain embodiment may reference to related descriptions of other embodiments.

The foregoing descriptions are some embodiments of the disclosure and are not intended to limit the disclosure. For those skilled in the art, the disclosure may have various changes and modifications. Any modifications, equivalent replacements and improvements made within the spirit and principle of the disclosure shall fall within the protection scope of the disclosure.

What is claimed is:

1. A pump body assembly, comprising:

a cylinder assembly;

a flange portion, wherein the flange portion is connected to the cylinder assembly, a working cavity is formed between the flange portion and the cylinder assembly, and an avoidance portion is provided on a surface, located in the working cavity, of the flange portion;

a rotating shaft, wherein the rotating shaft passes through the flange portion and the cylinder assembly, and the rotating shaft is provided with a slide vane groove;

a slide vane, wherein the slide vane is slidably provided in the slide vane groove, an end face, towards the flange portion, of the slide vane is provided with an accommodation portion, a limiting structure is provided in the accommodation portion, the limiting structure is provided with an avoidance position in the accommodation portion, and at least part of the limiting structure is provided with a limiting position protruded out of a surface of the accommodation portion;

wherein, the rotating shaft drives the slide vane to be rotated, such that the working cavity corresponding to the slide vane performs an air suction operation and an air exhaust operation, when the working cavity performs the air suction operation, the limiting structure cooperates with the avoidance portion, such that the limiting structure is located at the limiting position, and a head of the slide vane is arranged at a distance from a cavity wall of the working cavity; and wherein the limiting structure comprises:

a ball, the ball is moveably provided in the accommodation portion; and a spring, the spring is provided in the accommodation portion, a first end of the spring is pressed against a side wall of the accommodation portion, and a second end of the spring is pressed against the ball, when the working cavity performs the air suction operation, a pre-tightening force is applied to the ball by the spring, such that a part of the ball is positioned outside the accommodation portion.

2. The pump body assembly as claimed in claim 1, wherein when the working cavity performs the air exhaust operation, the limiting structure is gradually far away from the avoidance portion, such that the limiting structure is gradually moved to the avoidance position.

3. The pump body assembly as claimed in claim 1, wherein the accommodation portion is a limiting groove, the limiting groove is installed on an end face at one side, towards the flange portion, of a slide vane body; or the accommodation portion is a limiting hole, the limiting hole is installed on the end face at the one side, towards the flange portion, of the slide vane body; or the accommodation portion is a limiting groove, the limiting groove is installed on an end face at one side, towards the flange portion, of a slide vane body, the accommodation portion is a limiting hole, the limiting hole is installed on the end face at the one side, towards the flange portion, of the slide vane body.

4. The pump body assembly as claimed in claim 1, wherein the flange portion comprises an upper flange and a lower flange, the avoidance portion is installed on the upper flange; or the avoidance portion is installed on the lower flange; or one avoidance portion is installed on the upper flange, another avoidance portion is installed on the lower flange.

5. The pump body assembly as claimed in claim 4, wherein the upper flange or the lower flange comprises a flange body, the flange body is provided with a shaft hole through which the rotating shaft passes, the avoidance portion comprises an avoidance concave portion, the avoidance concave portion is installed at a hole wall of the shaft hole, when the working cavity performs the air suction operation, the pre-tightening force is applied to the ball by the spring, such that a part of the ball is positioned in the avoidance concave portion, and a surface of the part of the ball is pressed against a side wall of the avoidance concave portion, so the head of the slide vane is arranged at a distance away from a cavity wall of the working cavity.

6. The pump body assembly as claimed in claim 5, wherein the avoidance concave portion comprises:

a limiting section, the limiting section is installed at an edge of the shaft hole, a depth direction of the limiting section is extended to be configured along an axis direction of the shaft hole, a bottom surface at one side, close to the shaft hole, of the limiting section is aligned to a hole edge of the shaft hole, the limiting section is provided with a limiting surface, the limiting surface is configured away from the hole edge of the shaft hole and configured to form an included angle with the bottom surface, when the ball is positioned in the limiting position, a part of the ball is pressed against the limiting surface.

7. The pump body assembly as claimed in claim 6, wherein the avoidance portion further comprises:

a first transition section, a first end of the first transition section is connected with a first end of the limiting section, a second end of the first transition section is connected with a surface at one side, towards the working cavity, of the flange body, a height from the first end of the first transition section to the second end of the first transition section is gradually increased, such that the ball is gradually moved into the accommodation portion, until the ball is positioned in the avoidance position.

8. The pump body assembly as claimed in claim 7, wherein the avoidance portion further comprises:

a second transition section, a first end of the second transition section is connected with a second end of the limiting section, a second end of the second transition section is connected with the surface at the one side, towards the working cavity, of the flange body, a height from the first end of the second transition section to the second end of the second transition section is gradually increased and gently extended to be configured, such that the ball is gradually slid out from the accommodation portion, until the ball is positioned in the limiting position.

9. The pump body assembly as claimed in claim 1, wherein there are multiple slide vane grooves, and there are multiple slide vanes, the multiple slide vane grooves and the multiple slide vanes are configured correspondingly one by one, and the working cavity is formed between the two neighboring slide vanes.

10. A compressor, comprising a pump body assembly, wherein the pump body assembly is the pump body assembly as claimed in claim 1.

11. The compressor as claimed in claim 10, wherein when the working cavity performs the air exhaust operation, the limiting structure is gradually far away from the avoidance portion, such that the limiting structure is gradually moved to the avoidance position.

12. The compressor as claimed in claim 10, wherein the accommodation portion is a limiting groove, the limiting groove is installed on an end face at one side, towards the flange portion, of a slide vane body; or the accommodation portion is a limiting hole, the limiting hole is installed on the end face at the one side, towards the flange portion, of the slide vane body; or the accommodation portion is a limiting groove, the limiting groove is installed on an end face at one side, towards the flange portion, of a slide vane body, the accommodation portion is a limiting hole, the limiting hole is installed on the end face at the one side, towards the flange portion, of the slide vane body.

13. An air conditioner, comprising a pump body assembly, wherein the pump body assembly is the pump body assembly as claimed in claim 1.

14. A slide vane structure, comprising:

a slide vane body, at least one end surface of the slide vane body is provided with an accommodation portion; and a limiting structure, the limiting structure is moveably provided in the accommodation portion, the limiting structure has an avoidance position positioned in the slide vane body, and the limiting structure has a limiting position protruded out of a surface of the slide vane body;

wherein the limiting structure comprises:

a ball, the ball is moveably provided in the accommodation portion; and a spring, the spring is provided in the accommodation portion, a first end of the spring is pressed against a side wall of the accommodation portion, and a second end of the spring is pressed against the ball, a pre-tightening force is applied to the ball by the spring, such that a part of the ball is positioned outside the accommodation portion.

15. The slide vane structure as claimed in claim 14, wherein the accommodation portion is a limiting groove, the limiting groove is installed on an end face at one side, towards the flange portion, of the slide vane body; or the accommodation portion is a limiting hole, the limiting hole is installed on the end face at the one side, towards the flange portion, of the slide vane body; or the accommodation portion is a limiting groove, the limiting groove is installed on an end face at one side, towards the flange portion, of the slide vane body, the accommodation portion is a limiting hole, the limiting hole is installed on the end face at the one side, towards the flange portion, of the slide vane body.

16. The slide vane structure as claimed in claim 14, wherein the slide vane body is provided with an air exhaust hole communicated with the accommodation portion.

17. The slide vane structure as claimed in claim 16, wherein there are two accommodation portions, the two accommodation portions are respectively provided on two opposite end faces of the slide vane body, the two accommodation portions are configured to be communicated, the air exhaust hole is provided in a middle of a tail of the slide vane body, and the air exhaust hole is communicated with the two accommodation portions.

* * * * *